US005873199A

United States Patent [19]

Meunier et al.

[11] Patent Number: 5,873,199

[45] Date of Patent: Feb. 23, 1999

[54] LOCKING DEVICE FOR FULL TILT WINDOWS

[75] Inventors: Scott Meunier; Richard Skallerud; Lawrence VerSteeg, all of Sioux Falls; Gary Newman, Valley Springs, all of S. Dak.

[73] Assignee: Amesbury Group, Inc., Amesbury, Mass.

[21] Appl. No.: 880,265

[22] Filed: Jun. 23, 1997

Related U.S. Application Data

[63] Continuation-in-part of Ser. No. 687,684, Jul. 26, 1996, Pat. No. 5,737,877.

[51] Int. Cl.[6] ..... E05D 15/22

[52] U.S. Cl. ..... 49/181; 49/176; 49/445

[58] Field of Search ..... 49/176, 181, 445, 49/446, 447

[56] References Cited

U.S. PATENT DOCUMENTS

| | | | |
|---|---|---|---|
| 2,987,758 | 6/1961 | Osten, Sr. . | |
| 3,012,292 | 12/1961 | Brengman . | |
| 3,222,733 | 12/1965 | Wahlfeld et al. . | |
| 3,429,071 | 2/1969 | Phillips | 49/181 |
| 3,797,168 | 3/1974 | Trout | 49/446 X |
| 4,190,930 | 3/1980 | Prosser | 16/197 |
| 4,271,631 | 6/1981 | Trout | 49/181 |
| 4,570,382 | 2/1986 | Suess | 49/430 |
| 4,887,398 | 12/1989 | Haltof | 49/181 |
| 4,914,861 | 4/1990 | May | 49/181 |
| 4,914,862 | 4/1990 | Gregory | 49/322 |
| 5,027,557 | 7/1991 | May | 49/181 |
| 5,033,235 | 7/1991 | Stark | 49/445 |
| 5,036,622 | 8/1991 | Stark | 49/445 |
| 5,077,939 | 1/1992 | Erickson | 49/380 |
| 5,117,586 | 6/1992 | Stark | 49/445 |
| 5,174,064 | 12/1992 | Stark | 49/445 |
| 5,189,838 | 3/1993 | Westfall | 49/181 |
| 5,542,212 | 8/1996 | Erickson et al. | 49/181 |
| 5,572,828 | 11/1996 | Westfall | 49/446 X |
| 5,737,877 | 4/1998 | Meunter et al. | 49/445 |

FOREIGN PATENT DOCUMENTS 1002338 8/1965 United Kingdom .

*Primary Examiner*—Jerry Redman
*Attorney, Agent, or Firm*—Testa, Hurwitz & Thibeault, LLP

[57] ABSTRACT

A locking device for countering the force exerted by a spring balance while a window sash is in a tilt position or removed from a tilt position in a window frame, includes a shoe and a sash pin, the shoe engaging the walls of a jamb or jambliner when the window sash is tilted or removed from a tilt position, and the sash pin having a tab for preventing disengagement from the shoe during installation in a window frame. The shoe includes a pair of arms, one of which terminates in a barb and the other of which terminates in an angled edge, such that upon rotation, the shoe forms a wedge within a jamb or jambliner. The shoe further includes a plurality of prongs disposed between the arms for retaining the sash pin, and a bore for retaining an attachment mechanism associated with a spring balance. In response to tilting of the window sash away from the vertical axis of the jamb or jambliner, the locking device assumes a locked position as the sash pin rotates the shoe, and the barb and the angled edge engage the walls of the jamb or jambliner. Once engaged, the shoe becomes wedged within the jamb or jambliner such that the shoe is locked in place and effectively counters the forces exerted thereon by the spring balance.

22 Claims, 12 Drawing Sheets

LOCKING DEVICE FOR FULL TILT WINDOWS

This application is a continuation in part of Ser. No. 08/687,684, filed Jul. 26, 1996, now U.S. Pat. No. 5,737, 877.

FIELD OF THE INVENTION

This invention relates to locking devices for single or double hung windows, more particularly, to a locking device of improved construction for countering the force exerted by a spring balance while a window sash is tilted or removed from a tilted position.

BACKGROUND OF THE INVENTION

The use of full-tilt windows have made easier the ability to clean, replace and repair the window sash and other components of the window assembly. Locking devices have been used with full-tilt single and double hung windows to counter the force exerted by a window balance while the window sash is tilted away from the vertical axis of a window jamb or jambliner.

Although conventional locking devices have generally proven effective, they are typically fabricated with numerous components that increase the complexity of assembly and the cost of the device. Additionally, many of such components require frequent replacement due to increased wear and tear. Other conventional locking devices are fabricated of materials of insufficient durability or thickness. Over time, these devices generally suffer from a reduced ability to counter the force of a window balance while the window sash is in a tilted position. As a result, curative measures, such as excessive manipulation of the sash or the use of additional sash pins, are often required to achieve locking. These measures however, typically increase the likelihood of window sash breakage.

Additionally, many locking devices easily disengage from the window sash pin during installation of a window unit in a window frame, adding to the complexity of installation. A window unit typically includes such components as a jamb or jambliner, a spring balance and a locking device. Often a contractor when installing a window unit, will lift the window unit from a rest position without concern as to whether the components are in a position such that disassembly may occur. As a result of such mishandling, the sash pin associated with the locking shoe often disengages from the unit, and the contractor must obtain another sash pin and reconfigure the sash pin and the locking shoe prior to installation. Although locking devices having an integral sash pin can provide relative ease of installation, such devices often make difficult subsequent disengagement of the sash from the device.

Still other locking devices are not easily removed from a jamb or a jambliner after installation. These devices often necessitate removal of the entire window unit when the locking device is in need of repair or replacement.

It is therefore an object of the present invention to provide a locking device that overcomes the above-noted problems of conventional locking devices. Particularly, it is an object of the present invention to provide a locking device of reduced cost and increased reliability comprising a substantially integral, durable locking member that effectively counters the force of a spring balance when a window sash is tilted or removed from the window frame. It is another object of the present invention to provide a locking device that securely retains a sash pin during installation and provides ease of removal of the sash pin and window sash after installation. These and other objects are achieved by the locking device of the present invention.

SUMMARY OF THE INVENTION

The locking device of the present invention comprises, in one embodiment, a block-like member or shoe having a pair of arms, one of which has a projection emanating therefrom, and the other of which has a bore disposed therein for receiving a pulley cord of a block and tackle balance. In an alternative embodiment, a wire-form coupling can be disposed in the bore for connecting the shoe to the pulley cord. As the window sash moves vertically within the window frame, the locking device slides within the jamb or jambliner, and as the window sash tilts away from the vertical axis of the jamb or jambliner, the locking device rotates and the projection engages a wall of the jamb or jambliner. In various embodiments, the projection can comprise a barb for piercing a wall of the jamb or jambliner, or a flat-edged member for impinging against a wall of the jamb or jambliner.

In another embodiment, one or more prongs are disposed between the arms for retaining during installation, a sash pin. In this embodiment, a sash pin that couples the locking device to a window sash has a tab at one end adapted to lie against a wall of the shoe, thus preventing disengagement of the shoe from the sash pin during installation. The sash pin can further include a portion having a reduced diameter adjacent the tab, such that at least one of the prongs engages the reduced portion to ensure that the sash pin remains assembled with the shoe. By engaging the sash pin, the prongs prevent "pull out" of the sash pin, thus allowing the locking device and window balance to be installed within the jamb or jambliner as an integral unit. After installation of the locking device, the sash pin can be removed from engagement with the locking shoe, thus permitting a window sash to be removed from the jamb or jambliner with relative ease.

In another embodiment, an upper prong extends from one of the arms of the locking shoe. In this embodiment, the upper prong can be used to allow the sash pin and thus, the window sash, to be removed from engagement with the locking shoe only at predetermined angles to the upper prong.

In still other embodiments, the arm coupled to the spring balance further includes an angled edge for engaging a wall of the jamb or jambliner when the shoe is rotated. In this embodiment, the angled edge, in combination with the barb, allows the shoe to form a wedge within the jamb or jambliner as the window sash tilts away from the vertical axis of the jamb or jambliner, or as the window sash is removed from engagement with the locking shoe from a tilted position. The forces exerted by the barb and the angled edge lock in place the shoe until the window sash is returned to a position parallel to the axis of the jamb or jambliner. As the window sash returns to a position parallel to the axis of the jamb or jambliner, the sash pin rotates the shoe back to an unlocked position and the shoe is again slidably disposed within the jamb or jambliner.

In still another embodiment, the locking shoe is sized to be removed through a plough opening in the jamb or jambliner, thus allowing the locking shoe to be easily replaced after installation without requiring removal of the jamb or jambliner.

These and other features of the invention will be more fully appreciated by reference to the following detailed description which is to be read in conjunction with the attached drawings.

DETAILED DESCRIPTION OF THE INVENTION

Figure 1:
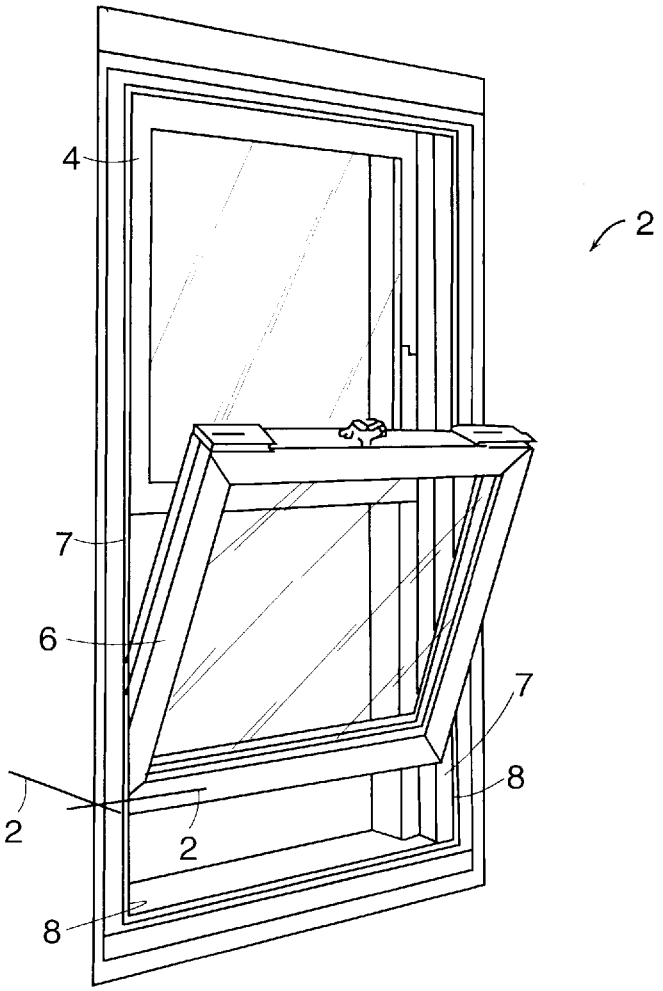
FIG. 1 is a front elevational view of a window frame assembly having double hung window sashes, with one of the sashes tilted away from the vertical axis of the window jamb.

Referring to FIG. 1, shown is a double hung window frame 2. A pair of window sashes 4, 6 are disposed in vertical alignment with the window jamb 7 and the jambliners 8, each of which are disposed on a side of the frame 2. The sashes 4, 6 can undergo vertical movement and can be tilted away from the window frame 2, as shown by the bottom sash 6. As further described, disposed within each window jamb 7 or jambliner 8 is the locking device (not shown) of the present invention coupled to a spring balance (not shown) for countering the force exerted by the balance as the window sash 6 is titled or removed from a tilt position.

Figure 2:
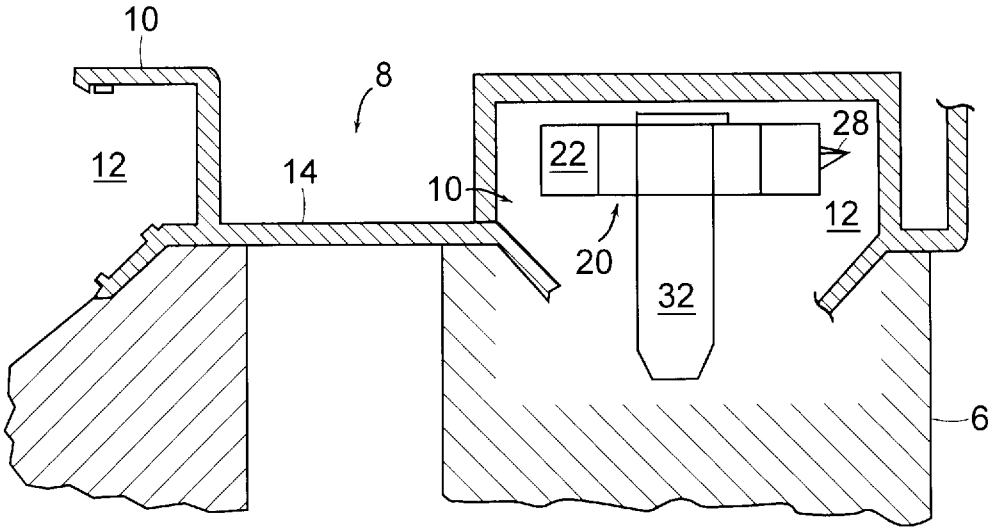
FIG. 2 is a top sectional view of a jambliner and the locking device according to one embodiment of the present invention taken along lines 2—2 of FIG. 1.

Referring to FIG. 2, shown is a top sectional cut-away view of the jambliner 8 and the locking device 20 of the present invention, taken along lines 2—2 of FIG. 1. Although the locking device 20 of the present invention can be used within the window jamb 7 or the window jambliner 8, for purposes of illustration only, the locking device 20 of the present invention is described herein in connection with a window jambliner 8. It is to be appreciated, however, that the operation of the locking device in a window jamb 7 is substantially similar to that described below, and that the description herein similarly applies to the operation of the locking device in a window jamb 7.

As shown, the jambliner 8 includes walls 10 defining sash-engaging portions 12, which are separated by a mullion 14. In this embodiment, the jambliner 8 is preferably fixedly disposed in a window frame (2) fabricated of a durable material, such as, for example, polyvinylchloride (PVC), aluminum, or pultruded fiberglass. It is to be appreciated however, that the locking device 20 of the present invention can be used with a jambliner of other construction, such as, for example, a floating jambliner of the type typically used in a window frame fabricated of wood. Similarly, it is to appreciated that the locking device 20 of the present invention can be used with a window jamb (7) fabricated of PVC, for example.

As shown in FIG. 2, disposed within each sash-engaging portion 12 is the locking device 20 of the present invention. The locking device 20 is preferably sized such that in an unlocked position, there exists sufficient clearance between the locking device 20 and the walls 10 of the jambliner 8, and in a locked position, the locking device engages the walls 10 of the jambliner 8. In this figure, the locking device 20 is shown in an unlocked position with respect to the jambliner 8. As further described in FIGS. 11A and 11B, the locking device 20 can be sized to be easily removed from the plough (not shown) of the jambliner 8 when the locking device 20 is in need of repair or replacement.

As shown, the locking device 20 comprises a locking shoe 22 and a sash pin 32. In the present embodiment, the locking shoe 22 comprises a block-like member having a projection at one end thereof, which can take in the form of a barb 28. As will be further described, the barb 28 engages the wall 10 of the sash-engaging portion 12 of the jambliner 8 when the locking shoe 22 is in the locked position. The locking shoe 22 is connected to the window sash 6 by the sash pin 32 and is connected to an end of a spring balance by an attachment mechanism (not shown), as further described in FIGS. 3A, 3B and 3C. As the window sash 6 undergoes vertical movement, the locking device 20 slidably moves within the jambliner 8. Similarly, as the window sash 6 undergoes tilting movement, the locking device 20 rotates and the barb 28 moves into engagement with the walls 10 of the jambliner 8, such that the locking shoe 22 forms a wedge within the sash-engaging portion 12 of the jambliner.

Figure 3A:
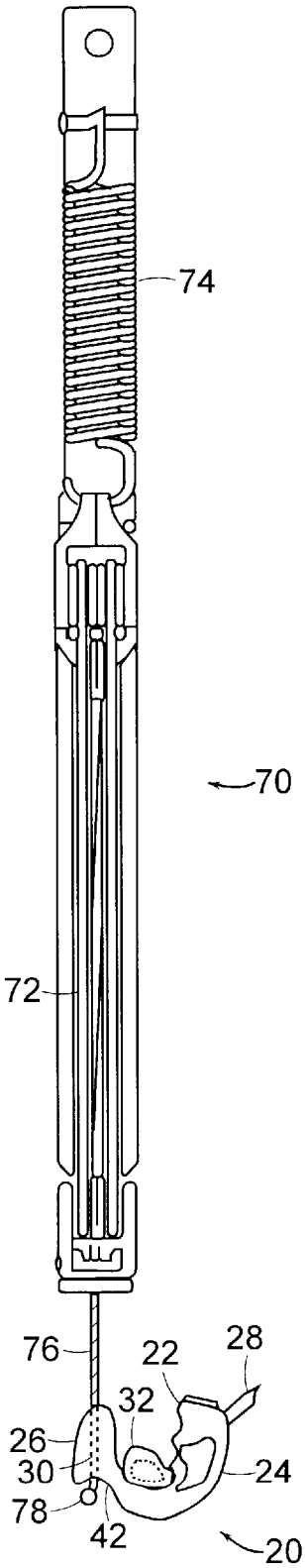
FIG. 3A is a side view of the locking device according to one embodiment of the present invention attached to a block and tackle balance.

Referring to FIG. 3A, shown is a side view of the locking device 20 of one embodiment of the present invention attached to a spring balance 70. The spring balance 70, shown for purposes of illustration, is a block and tackle balance. The block and tackle balance 70 is described in detail in commonly assigned, copending U.S. patent application Ser. No. 08/687,684, now U.S. Pat. No. 5,737, 877, the contents of which are incorporated herein by reference. The balance 70 comprises a pulley unit 72 coupled to a spring 74. A balance cord 76 associated with the pulley unit 72 causes elongation or contraction of the spring 74 when a force is exerted thereon in response to movement of a window sash (6). It is important to note however, that the locking device 20 of the present invention can be used with a variety of balances and should not be limited to the block and tackle balance 70 shown.

The locking shoe 22 of the present invention comprises a pair of arms 24, 26. As shown in the present embodiment, the barb 28 extends from arm 24 and a latitudinally extending bore 30 is formed within arm 26 for receiving the balance cord 76. The balance cord 76 is retained within the bore 30 by a bottom wall 42 of the shoe 22 through a retaining member 78. The retaining member 78 can comprise a knot, or a solid member attached to an end of the balance cord 76. The retaining member 78 generally can assume any shape and size, provided that the retaining member 72 has a diameter greater than the diameter of the bore 30 and can withstand the forces exerted on the locking shoe 22.

As described above, the sash pin 32 attaches to the window sash (6) such that vertical movement as well as tilting movement of the window sash (6) is imparted to the locking shoe 22. As the locking shoe 22 is connected to the balance 70 through the balance cord 76, rotation of the sash (6) about the sash pin 32 causes the locking shoe 22 to rotate and become wedged within the sash-engaging portion 12 of the jambliner 8, thus exerting a force on the balance cord 76. The balance cord 76, in response to this force, exerts a force on the pulley unit 72, which in turn causes an elongation or a contraction of the spring 74 depending on the direction of movement of the sash (6). The tilted sash (6) is thus held in place by the cooperating relationship of the sash pin 32, the shoe 22 and the balance 70. When the sash (6) is removed from a tilt position, the locking shoe 22 remains wedged in place to counter the force exerted by the balance (70) and to maintain a position in which the window sash (6) can be easily reintroduced to the window frame (2).

Figure 3B:
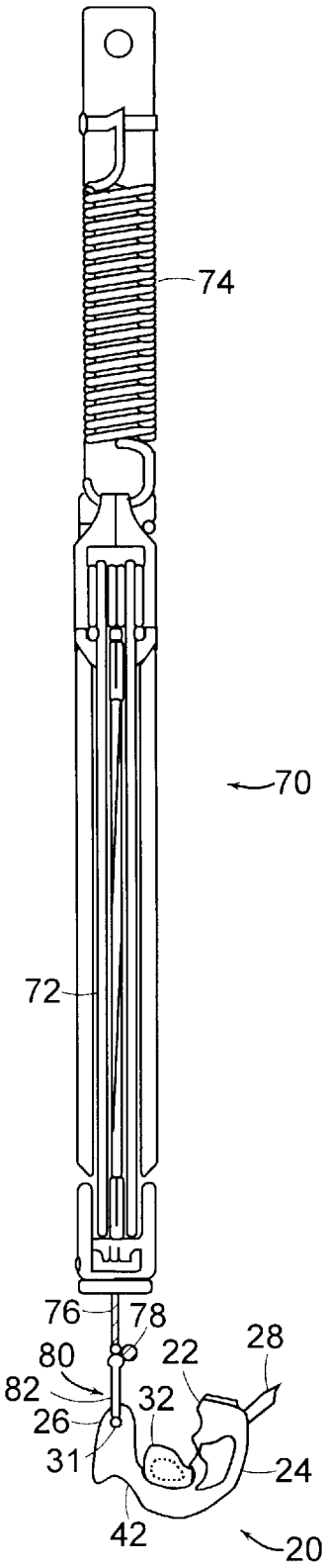
FIG. 3B is a side view of the locking device according to one embodiment of the present invention attached to a block and tackle balance by a wire-form coupling.

Referring to FIG. 3B, shown is another embodiment of the present invention in which a wire-form coupling 80 is used to attach the locking shoe 22 to a spring balance 70. The wire-form coupling 80 allows the locking shoe 22 to be hingedly connected to the balance cord 76 associated with the spring balance 70. The wire-form coupling 80 is shown in greater detail in FIG. 3C.

Figure 3C:
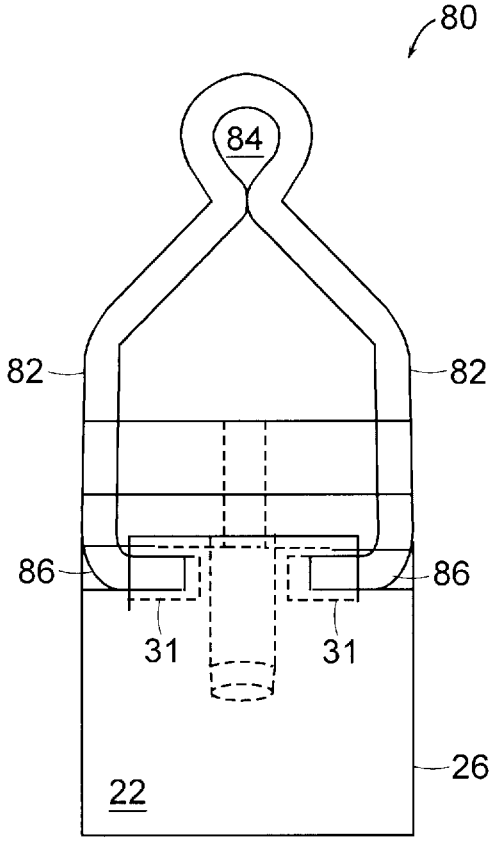
FIG. 3C is a side view of the wire-form coupling of FIG. 3B attached to the locking shoe according to one embodiment of the present invention.

Referring to FIG. 3C, shown is a side view of the wire-form coupling 80 attached to the locking shoe 22. As shown, the wire-form coupling 80 includes forked members 82 extending continuously from a cord-receiving loop 84. In this embodiment, each of the forked members 82 terminates at an L-shaped end 86. A pair of longitudinally extending bores 31 are disposed within the upper portion of the arm 26 of the locking shoe 22 for receiving the L-shaped ends 86 of the wire-form coupling 80. The connection of the L-shaped ends 86 within the bores 31 enables the wire-form coupling 80 to form a hinge connection with the locking shoe 22.

Referring again to FIG. 3B, the cord-receiving loop 84 couples the locking shoe 22 to the spring balance 70. The diameter of the loop 84 is sized to retain a knot 78 or other retaining member disposed at an end of the cord 76. In this embodiment, the wire-form coupling 80 allows the force exerted by the spring balance 70 to be smoothly and evenly transferred to the locking shoe 22 when the locking shoe 22 assumes a locked position within the sash-engaging portion 12 of the jambliner 8.

Figure 4:
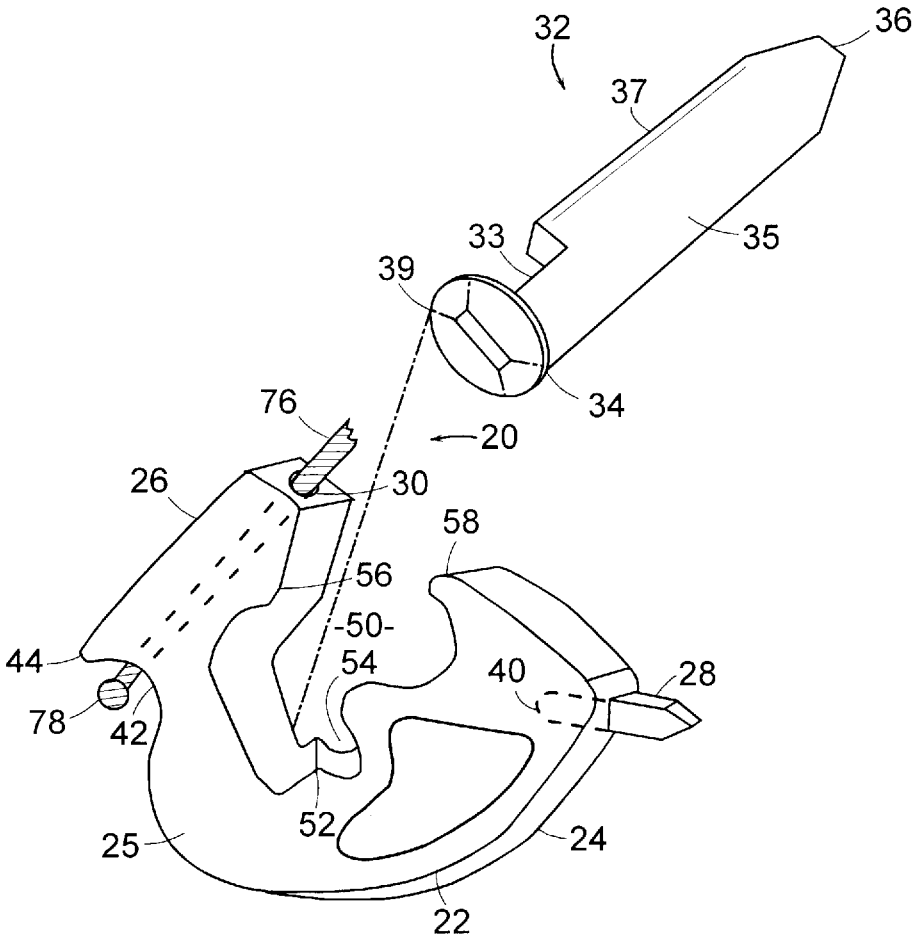
FIG. 4 is an exploded view of the locking device according to one embodiment of the present invention.

Referring to FIG. 4, shown is an exploded view of the embodiment of the locking device 20 of FIGS. 3A and 3B. As shown, the locking shoe 22 of the present embodiment is preferably of a certain thickness, such as, for example, 6 to 12 mm, and is preferably formed of a durable material such glass-filled nylon or PVC. Alternatively, the locking shoe 22 can be fabricated from such processes as zinc die-casting or steel stamping, for example. In the present embodiment, the thickness and hardness of the shoe 22, as well as the U-shape of the shoe 22, renders the shoe 22 able to withstand and evenly counter the forces exerted by the spring balance (70) while the window sash (6) is in a tilt position or after removal of the window sash (6) from a tilt position. It is to be appreciated however, that the shoe 22 can have a thickness outside of those thicknesses in the above-described range, and can comprise other durable materials available to those skilled in the art.

As described above, in the present embodiment of the invention, the arm 24 has a barb 28 emanating therefrom. The barb 28 can be integrally formed with the arm 24, or can be received within a bore 40 defined within the arm 24 to facilitate replacement should the barb 28 undergo wear and tear from repeatedly engaging the jambliner wall (10) as the shoe 22 assumes a locked position. It is to be appreciated that in other embodiments of the present invention, the projection 28 extending from the arm 24 can include a non-pointed or flat-edged member. As further shown, the arm 26 has a curved bottom wall 42, and a bore 30 for receiving a balance cord 76 associated with a pulley unit (72) of a spring balance (70). The cord 76 is disposed within the bore 30 and includes a retaining member 78 at an end of the cord 76 that is retained by the curved wall 42. Alternatively, a bore (31) can be disposed in an upper portion of the arm 26 for retaining a wire-form coupling (80) as described above in FIG. 3C.

The curved wall 42 terminates in an angled edge 44 that serves to wedge the locking device 20 within the sash-engaging portion 12 of the jambliner (8) when the window sash (6) is tilted, further securing the locking device 20 in a locked position. In this embodiment, although the angled edge 44 does not pierce the jambliner wall (10) in the same manner as the barb 28, the angled edge 44 nonetheless engages the interior surface of the jambliner wall (10) with sufficient force to aid in locking the shoe 22 in place. As the length of the shoe 22 in the present embodiment can be longest between the barb 28 and the angled edge 44, and about equal to the width of the sash-engaging portion (12) of the jambliner (8), the shoe 22 can form a wedge within the sash-engaging portion (12) when in a locked position.

As described above, extending through an open area defined between the arms 24, 26 is a sash pin 32. In the present embodiment, one end 34 of the sash pin 32 includes a tab 39 for engaging a wall 25 of the shoe 22 to secure the sash pin 32 thereto. Such engagement avoids the problem of disassembly of the sash pin from the locking shoe, commonly associated with conventional window units. This feature of the present invention can be important during installation of a window unit in a window frame. As shown in the present invention, the arms 24, 26 joined by a curved wall 42, preferably define a U-shaped opening 50 within which the sash pin 32 resides. The sash pin 32 preferably has a reduced portion 33 possessing a diameter that is slightly less than the diameter of the main body 37 of the sash pin 32. The reduced portion 33 is adjacent the end 34 of the sash pin 32, at which a tab 39 or flange resides. Opposite the tab 39 is a tapered end 36 that attaches to the window sash (6). A plurality of prongs 52, 54, 56 extend from the shoe 22 between the arms 24, 26, and an upper prong 58 extends from the end of arm 24 opposite the barb 28. In the present embodiment, the prongs 52, 54, 56, 58 are integrally formed in the shoe 22, however, it is to be appreciated that prongs 52, 54, 56, 58 can take the form of interfitting members that mate with similarly shaped openings (not shown) in the shoe 22.

As shown in this figure, prong 56 can be configured to engage the reduced portion 33 of sash pin 32, and prong 54 can be configured to engage and partially encircle the outer surface 35 of the sash pin 32. The tab 39 typically abuts the wall 25 of the shoe 22 when the sash pin 32 is disposed in the U-shaped opening 50. Such engagement aids in securing the sash pin 32 to the shoe 22 such that disengagement is avoided in the event that the window unit is mishandled during installation, a problem described above. After installation of the window unit, the sash pin 32 is attached to the window sash (6) such that movement of the window sash (6) at an angle to the vertical axis of the jambliner 8 causes corresponding movement of the shoe 22. Thereafter, the sash pin 32 is freely removable from engagement with the locking shoe 22, as further described in FIGS. 6A and 6B.

Figure 5A:
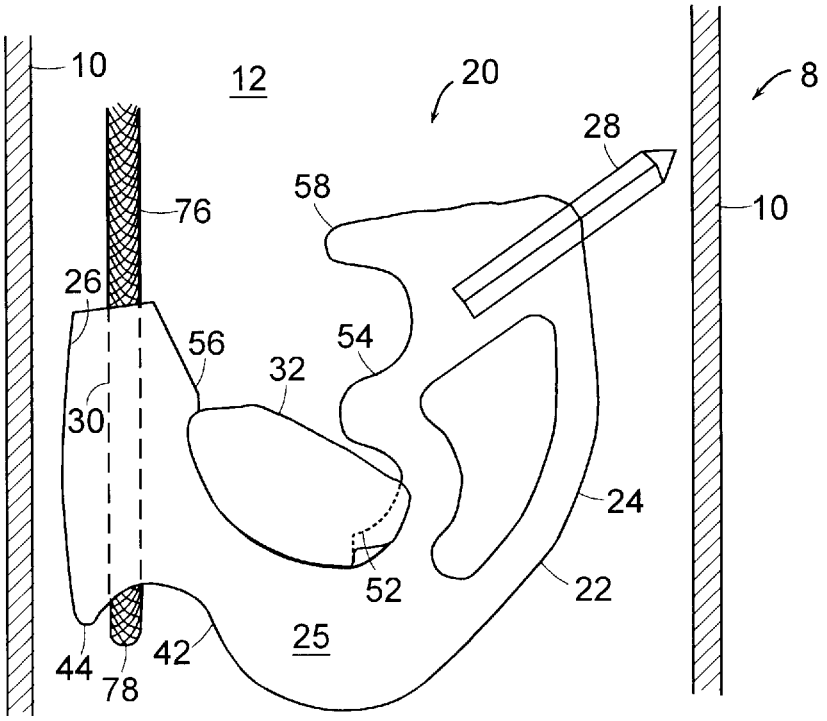
FIG. 5A is a side sectional view of the locking shoe of the embodiment of FIG. 4 in an unlocked position that results when the window sash is vertically disposed within the frame assembly.

Referring to FIG. 5A, shown is a side sectional view of the locking shoe 22 of the embodiment of FIG. 4 in an unlocked position that results when the window sash (6) is vertically disposed within the frame assembly (2). As shown in this figure, the barb 28 and the angled edge 44 clear the walls 10 of the sash-engaging portion 12 of the jambliner 8. Thus the locking device 20 slidably moves with the window sash (6) as the window sash (6) undergoes vertical movement in the window frame.

Figure 5B:
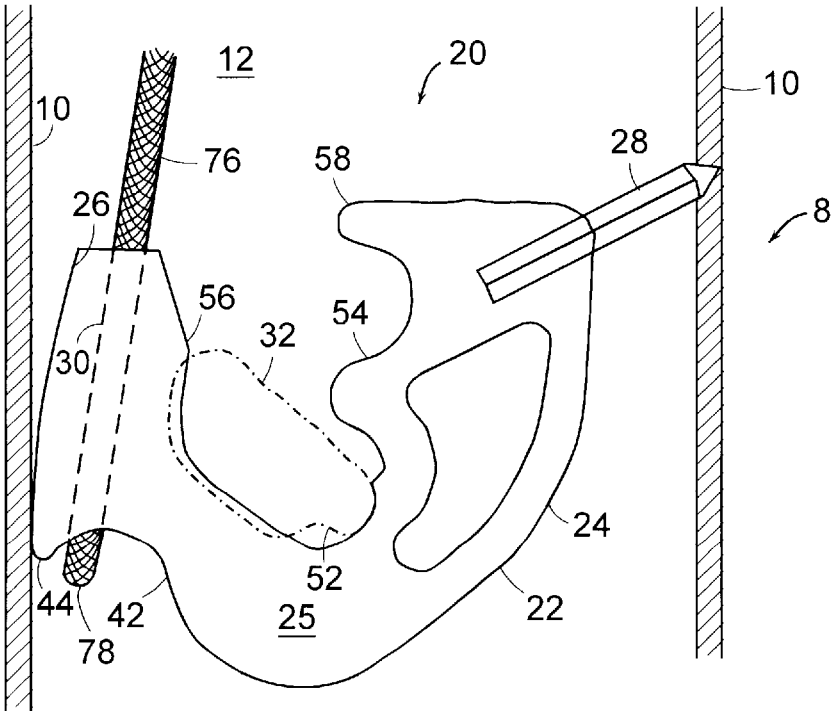
FIG. 5B is a side sectional view of the locking shoe of the embodiment of FIG. 4 in a locked position that results when the window sash is tilted at an angle to the vertical axis of the frame assembly or removed from engagement with the frame assembly.

Referring to FIG. 5B, the locking device 20 is shown in the locked position that results when the window sash (6) is tilted at an angle to the frame assembly (2) or removed from the frame assembly (2) from a tilted position. As the window sash (6) tilts, a force is exerted by the window sash (6) and transmitted to the sash pin 32 and the shoe 22, causing the shoe 22 to rotate from the position shown in FIG. 5A to the position shown in FIG. 5B. The shoe 22 rotates until the barb 28 pierces the wall 10 of the sash-engaging portion 12 of the jambliner 8 and the angled edge 44 abuts an opposing wall 10 of the sash-engaging portion 12. The shoe 22 comes to a stop when the barb 28 and the angled edge 44 exert a sufficient force against the opposed walls 10 of the sash-engaging portion 12, such that the shoe 22 becomes wedged within the sash-engaging portion 12 and locks into place. The shoe 22 typically assumes such a locked position when the window sash 6 is rotated to a tilt position at about 15° from the vertical axis of the jambliner 8. After assuming a locked position, the locking shoe 22 remains wedged within the sash-engaging portion 12 of jambliner 8 while the window sash (6) is tilted or removed from the window frame (2) from a tilt position, and continues to transfer to the jambliner 8 a force that counters the force exerted by the spring balance (70).

When disposed in a locked position, the locking shoe 22 of the present invention thus prevents a tilted window sash (6) from being pulled in an upward direction by the force exerted on the window sash (6) by the spring balance 70. Additionally, when one wishes to remove the window sash (6) for cleaning or replacement, the locking shoe 22 maintains the position of the spring balance 70 such that the window sash 6 can be easily re-installed at the position from which it was removed. When the window sash (6) is returned to a position parallel to the axis of the jambliner 8, the locking device 20 automatically releases from the locked position. As the sash pin 32 rotates, the locking shoe 22 also rotates and returns to the position shown in FIG. 5A, in which the barb 28 and the angled edge 44 no longer impinge upon the walls 10 of the jambliner 8.

Figure 6A:
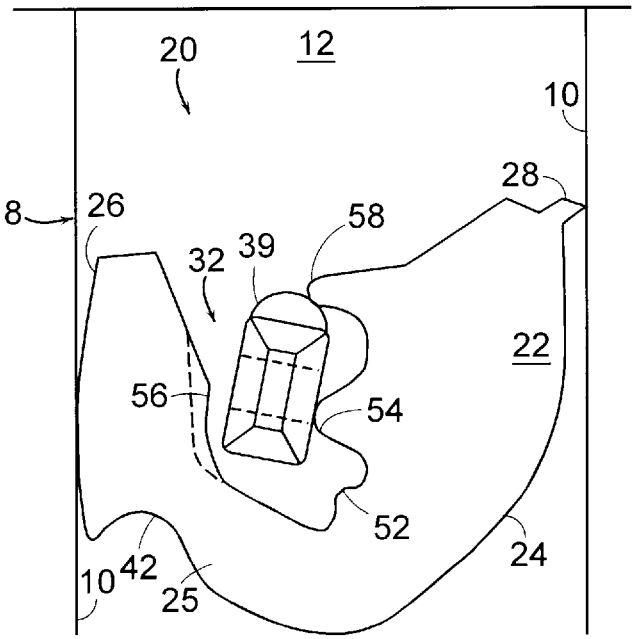
FIGS. 6A and 6B show the manner in which the sash pin can be rotated to permit disengagement of the sash pin from the locking shoe of the embodiment of FIG. 4.
Figure 6B:
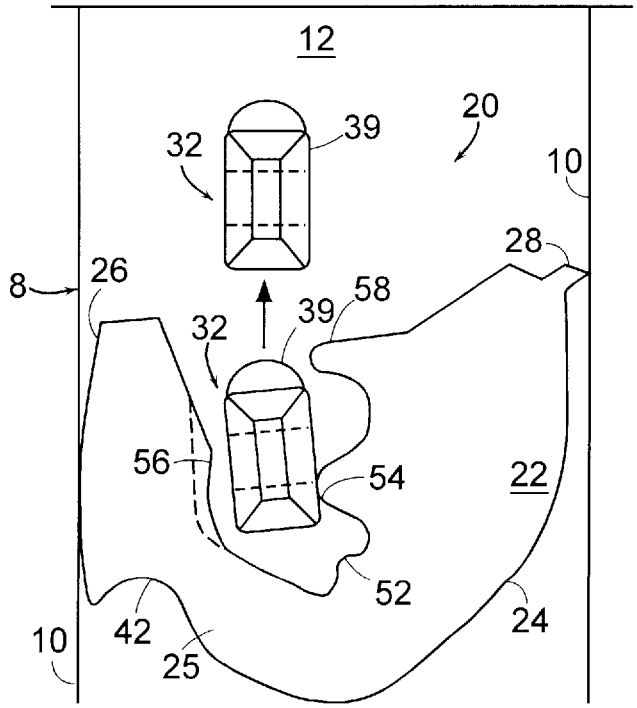

Referring to FIGS. 6A and 6B, shown is the manner in which the sash pin 32 can be rotated to permit disengagement or removal of the window sash (6) from the locking shoe 22 after the window sash (6) has been rotated to a tilt position, as shown in FIG. 4B. As stated above, upon installation, the sash pin 32 is engaged with the locking shoe 22 with the aid of the prongs 52, 54, 56 disposed between the retaining arms 24, 26. As shown in FIG. 6A, after the window sash (6) has been tilted, removal of the sash pin 32 from engagement with the locking shoe 22 can be initiated by rotating the sash pin 32 away from the arm 26 of the locking shoe 22. As the sash pin 32 is rotated away from the arm 26, it becomes disengaged from the shoe wall 25 and no longer imparts movement to the locking shoe 22. Therefore, the locking shoe 22 no longer rotates with the sash pin 32.

As shown in this figure, rotation of the sash pin 32 from an engaged position shown in FIG. 5A, that is, from a position where tab 39 overlaps wall 25, to an angle of greater than 90° to the horizontal axis of the locking shoe 22, results in the tab 39 of the sash pin 32 being retained by the upper prong 58. In this embodiment, the upper prong 58 can act as a safety catch to prevent removal of the sash pin 32 and ultimately, the window sash (6), from occurring at angles that would render the window sash (6) unstable and potentially susceptible to breakage.

Referring to FIG. 6B, removal of the sash pin 32 from engagement with the locking shoe 22 of the present embodiment can be accomplished by rotating the sash pin 32 from an engaged position to an angle of less than or equal to about 90° to the horizontal axis of the locking shoe 22. As shown, upon rotation of the sash pin 32 to such an angle to the horizontal axis of the locking shoe 22, the tab 39 of the sash pin 32 clears the upper prong 58, making the sash pin 32 easily removable with continued exertion of an upward vertical force on the sash (6).

Figure 7:
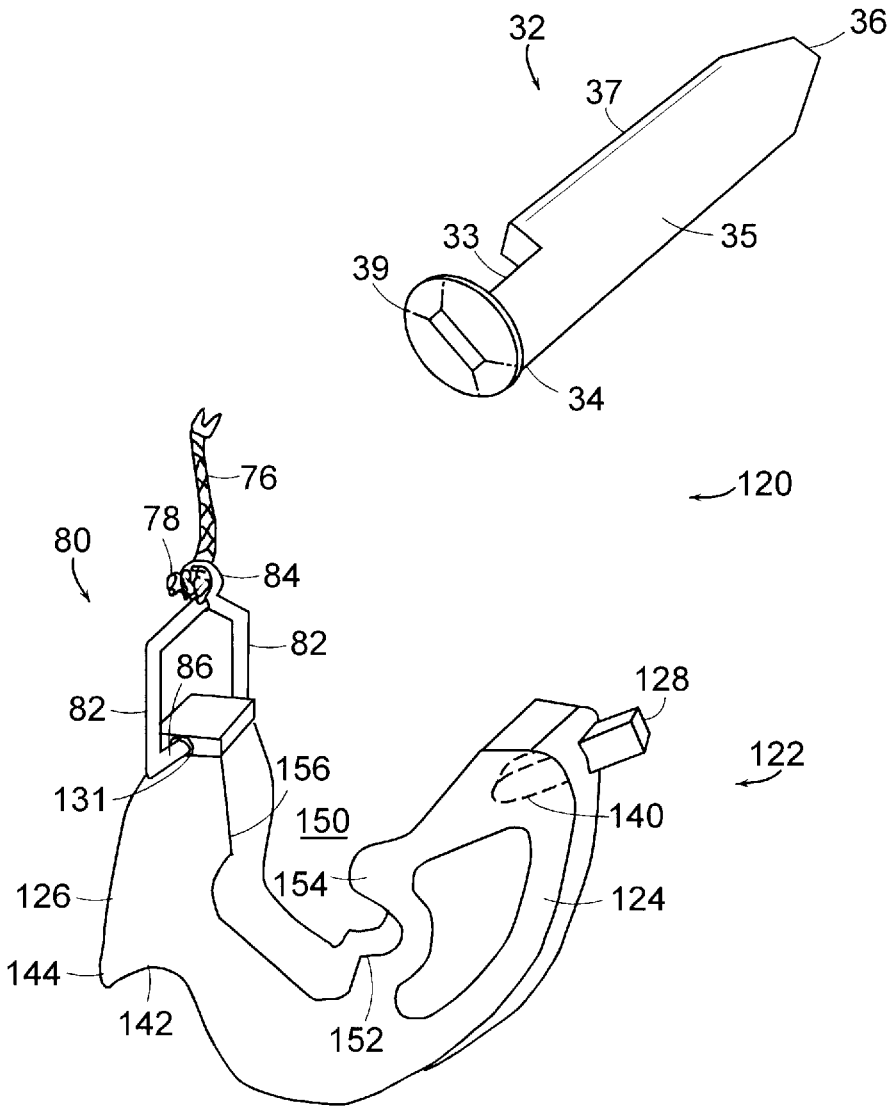
FIG. 7 is an exploded of an alternative embodiment of the locking device of the present invention.

Referring to FIG. 7, shown is an exploded view of an alternative embodiment of the locking device 120 of the present invention. As shown, the locking shoe 122 has a pair of arms 124, 126 joined at a curved wall 142 to define a U-shaped opening 150. In this embodiment, arm 124 terminates in a flat-edged projection 128 and arm 126 terminates in an upper end having a bore 131 disposed latitudinally therethrough. The arms 124, 126 include a plurality of prongs 152, 154, 156 that project into the U-shaped opening. Arm 126 terminates in an angled edge 144 to aid the locking shoe 122 in forming a wedge within the sash-engaging portion (12) of the jambliner (8). A sash pin 32, as similarly described above, is disposed within the U-shaped opening 150 defined by the arms 124 and 126 and engages prong 156 such that rotation of the sash pin 32 causes corresponding rotation of the locking shoe 122. In this embodiment, arm 124 extends linearly from prong 154 and does not include an upper prong as shown in the embodiment of FIG. 4. Forked members 82 of the wire-form coupling 80 extend to the locking shoe 22 and the L-shaped members 86 are each disposed within the bore 131. To connect the locking shoe 122 to a spring balance (70), the balance cord 76 is retained by the retaining member 78 that is held within loop 84. The operation of the locking device of the embodiment of FIG. 7 operates as similarly described above in connection with FIGS. 5A and 5B, and to eliminate redundancy, is not reiterated herein.

Figure 8A:
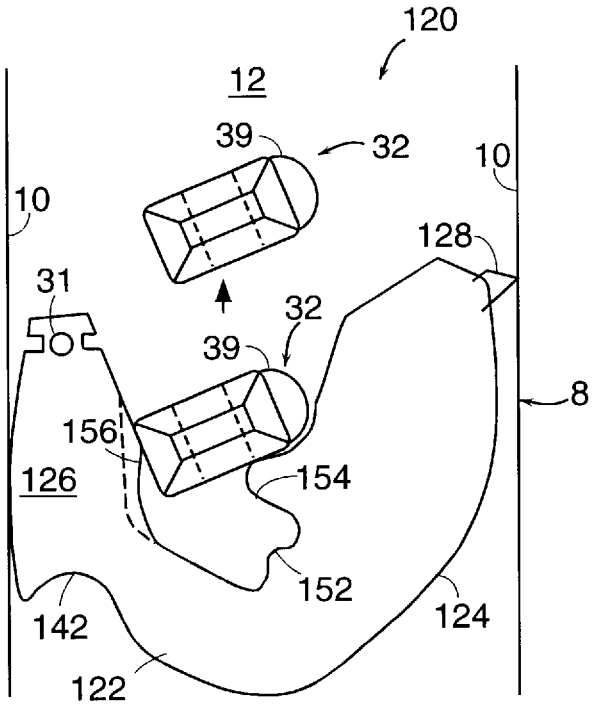
FIGS. 8A and 8B show the manner in which the sash pin can be rotated to permit disengagement of the sash pin from the locking shoe of the embodiment of FIG. 7.
Figure 8B:
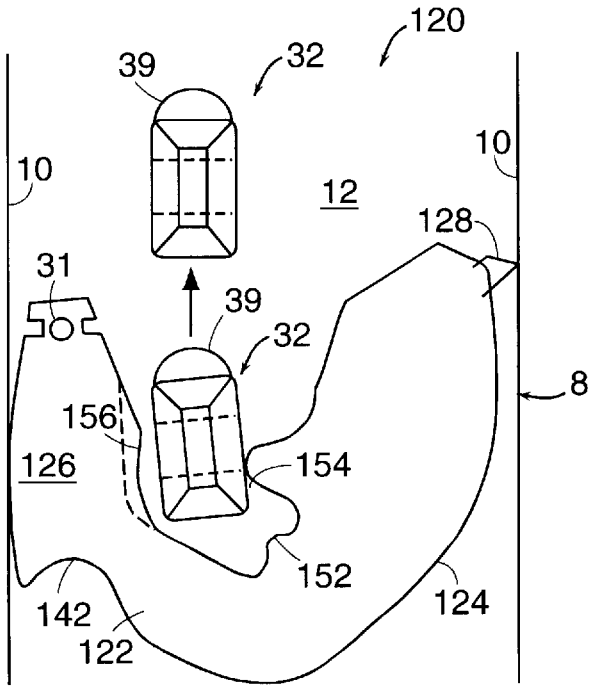

Referring to FIGS. 8A and 8B, shown is the manner in which the sash pin 32 can be rotated to permit disengagement of the window sash (6) from the locking shoe 122 of the embodiment shown in FIG. 7. After the sash pin 32 rotates to a tilt position, and the locking shoe 122 is in a locked position as shown, removal of the sash pin 32 from engagement with the locking shoe 120 can be carried out by rotating the sash pin 32 at an angle away from the arm 126. As described above, the rotation of the sash pin 32 away from arm 126 does not cause rotation of the locking shoe 122 because the sash pin 32 no longer engages the locking shoe 122. As such, the locking shoe 122 remains in a locked position within the sash-engaging portion (12) of the jambliner (8).

As shown in FIG. 8A, rotation of the sash pin 32 from an engaged position to an angle of greater than 90° to the horizontal axis of the locking shoe 122, provides for removal of the sash pin 32 from the locking shoe 122. As arm 124 extends linearly from the prong 154 and does not include an upper prong as described in FIG. 4, the sash pin 32 clears the locking shoe 122 when rotated at angles beyond 90° to the horizontal axis. For purposes of illustration only, the sash pin 32 shown in FIG. 8A is shown as having an angle of removal at about 135° to the horizontal axis, however it is to be appreciated that removal can occur at greater angles to the horizontal axis. As shown in FIG. 8B, the sash pin 32 can also be removed from the locking shoe 122 when rotated from an engaged position to an angle of less than or equal to 90° from the horizontal axis of the locking shoe 122, as similarly described above in FIG. 6B. The locking shoe 122 of the present embodiment provides ease of removal of a window sash (6) at about any angle between about 90° and 135°. The locking shoe 122 of the present embodiment can further be used when window sash stability during removal is not a concern or is accomplished by other means.

Figure 9:
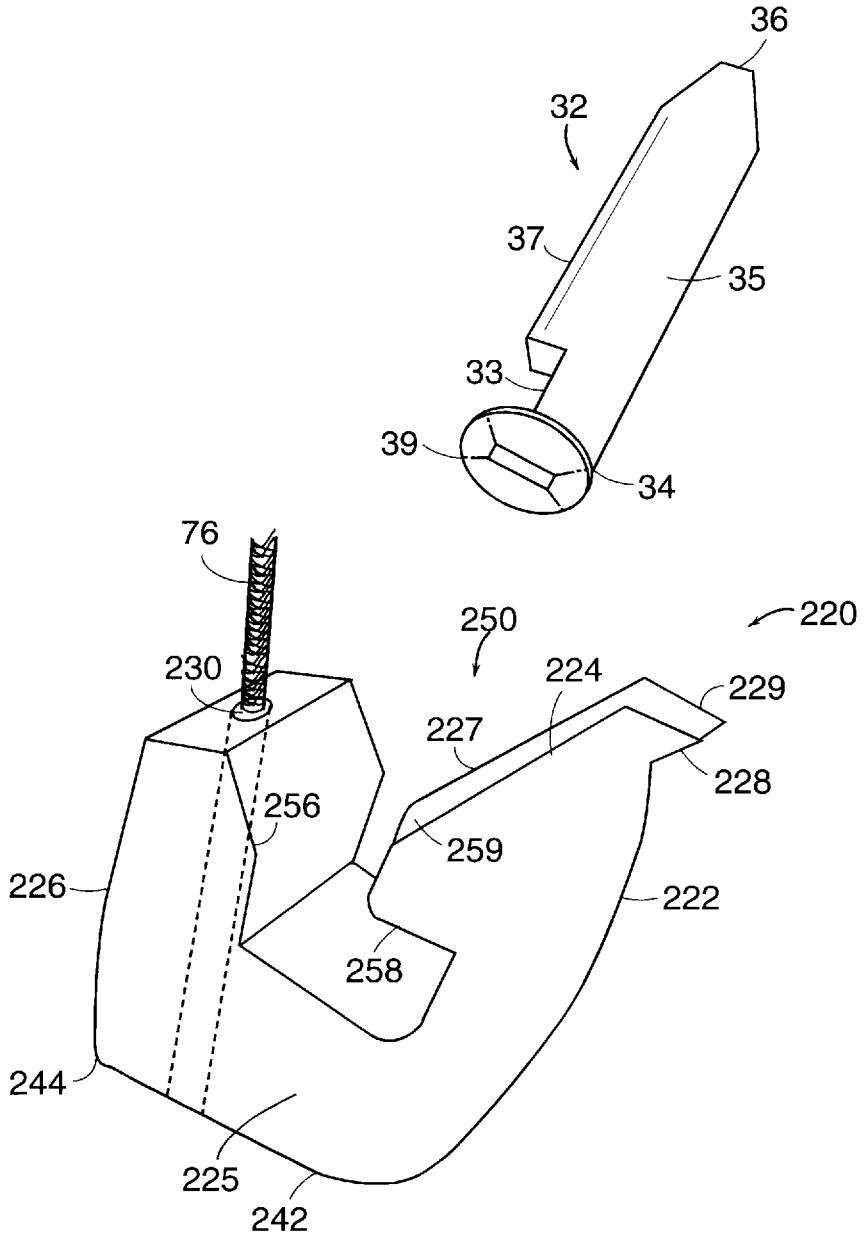
FIG. 9 is an exploded view of an alternative embodiment of the locking device of the present invention.

Referring to FIG. 9, shown is an exploded view of another embodiment of the locking device 220 of the present invention, comprising locking shoe 222 and sash pin 32. The locking shoe 222 of the present embodiment is preferably fabricated using a process of steel stamping. As shown in this figure, the locking shoe 222 includes a pair of coextending arms 224 and 227 joined to an arm 226 by a curved portion 242, defining a U-shaped opening 250. Coextending arms 224, 227 each have an integrally formed barb 228, 229 extending from an end thereof. Arm 226 has a bore 230 disposed therein for receiving a balance cord 76, and can include a sharp end 244. Arm 226 includes a prong 256 for retaining the sash pin 32 during installation, as similarly described above. Each of arms 224 and 227 include, in the present embodiment, a prong 258, 259. As similarly described in FIGS. 8A and 8B, the prongs 258, 259 provide for removal of the sash pin 32 at angles of about greater than 90° from an engaged position in which tab 39 overlaps shoe wall 225. When the locking shoe 222 is engaged with the sash pin 32, the locking shoe 222 rotates therewith, causing barbs 228, 229 to engage the jamb (7) or jambliner (8).

Figure 10A:
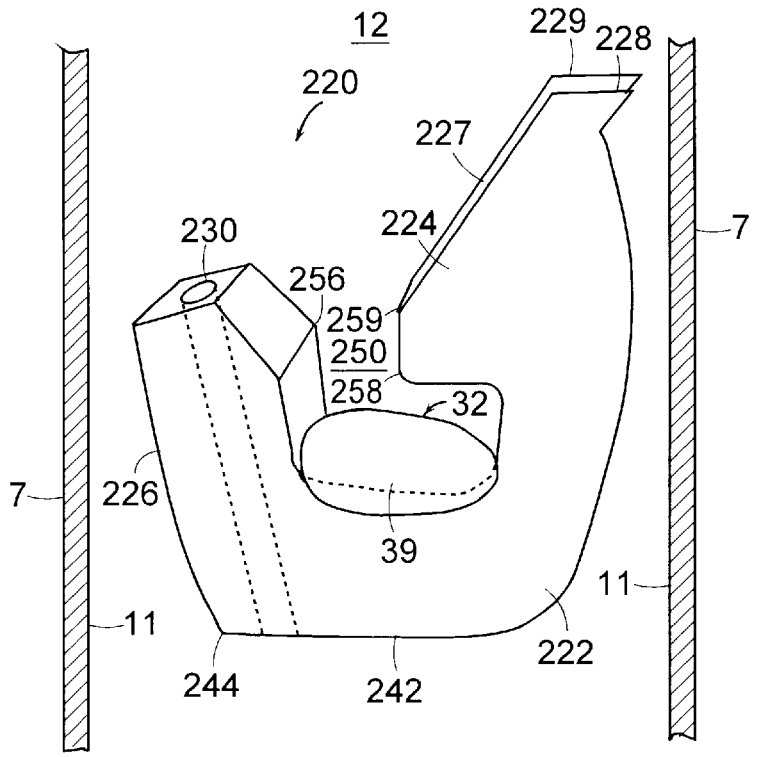
FIG. 10. A is a side sectional view of the locking shoe of the embodiment of FIG. 9 in an unlocked position that results when the window sash is vertically disposed within the frame assembly.
FIG. 10B is a side sectional view of the locking shoe of the embodiment of FIG. 9 in a locked position that results when the window sash is tilted at an angle to the vertical axis of the frame assembly or removed from engagement with the frame assembly.

Referring to FIG. 10A, shown is a side sectional view of the locking shoe 222 of the embodiment of FIG. 9 in a window jamb 7, in an unlocked position that results when the window sash (6) is vertically disposed within the frame assembly (2). As similarly described above, as the window sash (6) undergoes vertical movement in the window frame (2), the barbs 228, 229 clear the walls 11 of the jamb 7 and the locking shoe 222 slidably moves with the window sash (6) in the sash-engaging portion 12.

Figure 10B:
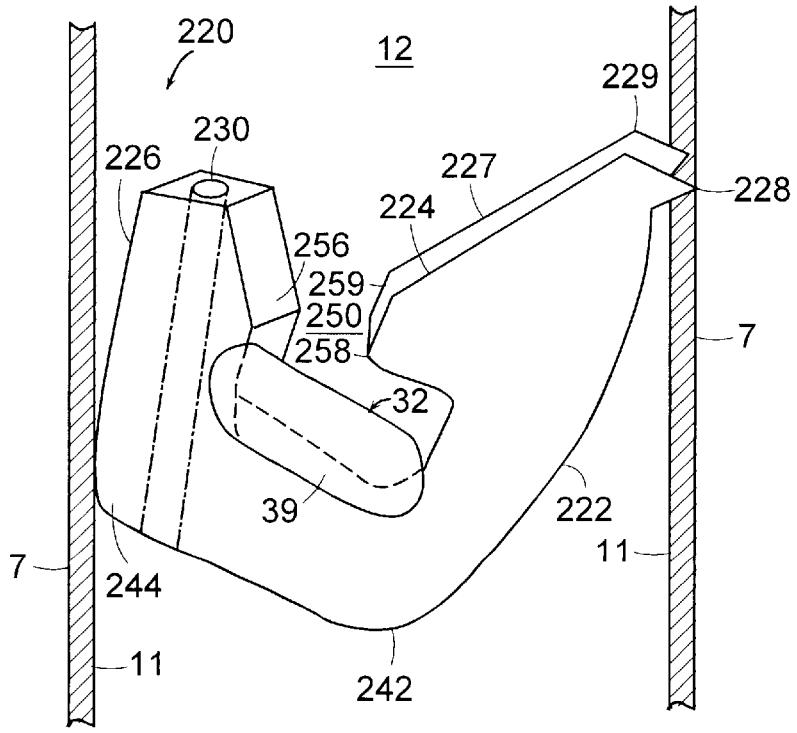

Referring to FIG. 10B, shown is the locking shoe 222 in a locked position that results when the window sash (6) is tilted at an angle to the frame assembly (2) or removed from the frame assembly (2) from a tilted position. As the window sash (6) tilts, the shoe 222 rotates and barbs 228, 229 pierce the wall 11 of the jamb 7. The shoe 222 comes to a stop when the barbs 228, 229 and the edge 244 exert a sufficient force against the opposed walls 11 of the jamb 7 to counter the force of the spring balance (70). An advantage to this embodiment of the present invention is that the barbs 228, 229 pierce the wall 11 of the jamb 7 in two locations, further securing the shoe 222 in a locked position.

Figure 11A:
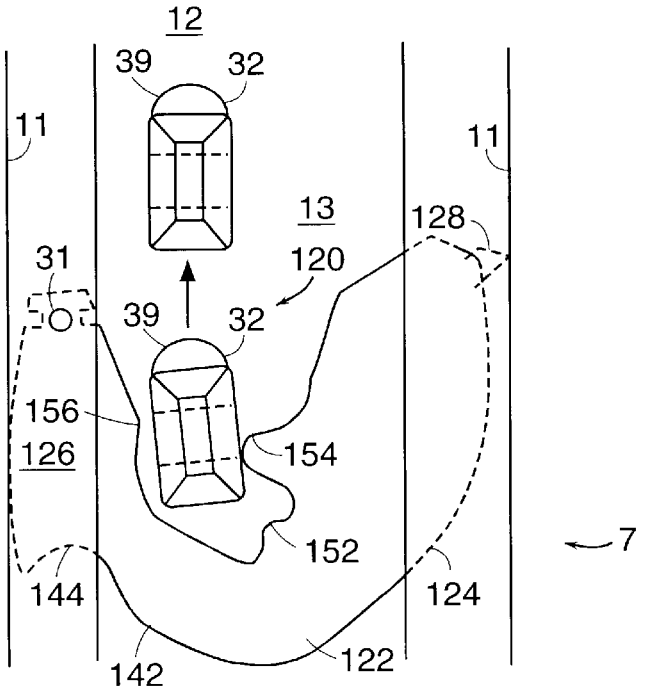
FIG. 11A is a perspective view of the locking device of the present invention disposed in a jambliner prior to removal.
Figure 11B:
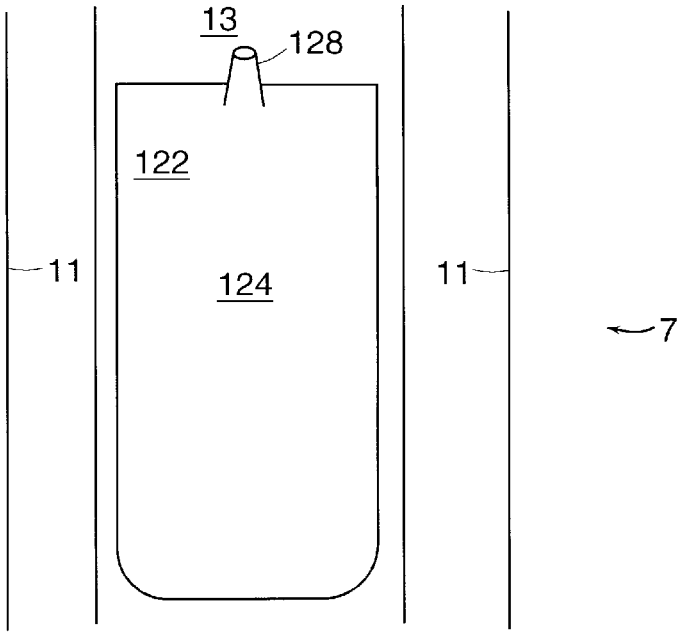
FIG. 11B is a perspective view of the locking device of the present invention being removed through a plough opening in the jambliner.

Referring to FIGS. 11A and 11B, removal of the locking shoe 122 of the embodiment of FIG. 7 through the plough opening 13 in the jamb 7 is shown. As shown in FIG. 1 A, when removal of the locking shoe 122 is desired, the sash pin 32 is first removed from engagement therewith. This is accomplished by rotating the sash pin 32 away from arm 126 and exerting a continued upward force thereon, as described above in FIGS. 8A and 8B. After the sash pin 32 has been removed, the locking shoe 122 can be rotated within the jamb 7 until the locking shoe 122 assumes the position shown in FIG. 11B. As shown in this figure, the width of the locking shoe 122 is less than the width of the plough opening 13. Therefore, the locking shoe 122 can be removed from the plough opening 13 by pulling the locking shoe 122 therefrom. This embodiment of the invention is useful in the event that repair or replacement of the locking shoe 122 is needed after installation. It is to be appreciated that the locking shoe 122 can be disposed within a jambliner (8) and removed from a plough opening therein, in a manner similarly described above.

While various embodiments of the invention have been set forth in detail, it should be understood that the above description is intended as illustrative rather than limiting and that many variations to the above-described embodiments will be apparent to those skilled in the art. The invention is to be described, therefore, not by the preceding description, but by the claims that follow.

What is claimed is:

1. A locking device slidably mounted in a jamb and locking in place against the jamb upon tilting of a window sash away from the vertical axis of the jamb, the locking device comprising:

a shoe comprising a first arm having a projection extending therefrom, a second arm, and a plurality of raised prongs disposed between the first arm and the second arm;

a coupling member for coupling the second arm to a spring balance; and a pin disposed within a U-shaped opening formed by the first arm and the second arm, the pin having a first end for engaging a window sash, a second end forming a tab for engaging a wall of the shoe, and a middle portion engaging at least one of the plurality of prongs, such that upon tilting the window sash, the pin rotates the shoe, causing the projection to engage the jamb and lock the shoe within the jamb.

2. The locking device according to claim 1, wherein the second arm has a bore defined therein for receiving the coupling member.

3. The locking device according to claim 2, wherein the coupling member comprises a balance cord having a retaining member at an end thereof.

4. The locking device of claim 2, wherein the coupling member comprises a wire-form coupling for retaining a balance cord.

5. The locking device according to claim 1, wherein the second arm has a sharp end for engaging the jamb as the pin rotates.

6. The locking device according to claim 5, wherein a length of the shoe is greatest between the projection and the sharp end.

7. The locking device according to claim 6, wherein the length of the shoe is about equal to a width of an interior space defined by the jamb, such that the shoe forms a wedge within the jamb when the pin rotates.

8. The locking device according to claim 1, wherein the first arm has a first bore defined therein for removably receiving the projection.

9. The locking device according to claim 1, the first arm further comprising an integrally formed retaining prong for limiting the angle at which the pin can be removed from engagement with the shoe.

10. The locking device according to claim 1, wherein the projection comprises a barb.

11. A locking system for a tiltable window sash comprising:

a shoe comprising:

a first arm having a first projection disposed at an end of the first arm;

a second arm connected to the first arm, having a second projection comprising an angled edge disposed at an end of the second arm; and a plurality of integrally formed retaining prongs disposed between the first arm and the second arm;

a pin disposed between the first arm and the second arm, the pin having a first end affixable to a window sash, a second end having a tab engaging the shoe, and a middle section of reduced diameter adjacent the tab engaging the retaining prongs; and a spring balance comprising:

a spring; and a pulley cord having a first end attached to the spring and a second end coupled to the second arm of the shoe to transmit a spring force therebetween;

whereby in response to rotation of the pin, the pin rotates the shoe and the shoe forms a wedge when disposed within a jamb to counter the spring force.

12. The locking system of claim 11, wherein the shoe further comprises a third arm coextenstive with the first arm, having a third projection disposed at an end thereof.

13. The locking system of claim 11, wherein at least one of the retaining prongs inhibits removal of the pin at predetermined angles to a horizontal axis of the shoe.

14. The locking system of claim 11, wherein a length of the shoe is greatest between the first projection and the angled edge.

15. The locking system of claim 11, wherein the first projection and the second projection each comprise a barb.

16. The locking device according to claim 11, wherein the second arm includes a bore extending therethrough.

17. The locking system of claim 16, wherein the pulley cord is disposed within the bore and secured to the second arm by a retaining member.

18. The locking system of claim 16, further comprising a wire-form coupling disposed within the bore, the wire-form coupling having a looped end for securing the pulley cord.

19. The locking device according to claim 11, wherein the shoe is sized to be removable through a plough opening in the jamb.

20. A locking device rotatably coupled to a window sash and a spring balance, the locking device locking in place upon tilting of the window sash away from a vertical axis of a jamb, the locking device comprising:

a shoe comprising:

a first arm having a bore disposed therein;

a barb removably disposed within the bore in the first arm for engaging the jamb;

a second arm connected to the first arm and forming a U-shape therewith, the second arm having a first end having a bore disposed therein for receiving an end of a spring balance cord, and a second end having an angled edge for engaging the jamb, wherein a length of the shoe is greatest between the angled edge and the barb;

a plurality of prongs integrally formed in the shoe and disposed between the first arm and the second arm for retaining a sash pin during installation of the device in a window frame; and a sash pin disposed between the first arm and the second arm, the sash pin comprising:

a first end for engaging the window sash;

a second end forming a tab for engaging a wall of the shoe, the tab having a diameter greater than the diameter of the first end; and a middle portion for engaging at least one prong;

wherein the sash pin rotates the shoe as the window sash tilts away from the vertical axis of the jamb, causing the barb and the angled edge to engage the jamb and become wedged within the jamb.

21. The locking device according to claim 20, wherein the length of the shoe is about equal to a width of a sash-engaging portion defined by the jamb.

22. The locking device according to claim 20, wherein a width of the shoe is less than a width of a plough opening formed in the jamb, such that the shoe is removable through the plough opening.

* * * * *